United States Patent [19]

Crawford

[11] 4,232,461

[45] Nov. 11, 1980

[54] PHONOGRAPH RECORD ALBUM INDEX TABS

[76] Inventor: Larry B. Crawford, 5959 S. Van Ness Ave., Los Angeles, Calif. 90047

[21] Appl. No.: 21,841

[22] Filed: Mar. 19, 1979

[51] Int. Cl.[3] ..... G09F 3/16

[52] U.S. Cl. ..... 40/23 A; 40/340; 40/2 R

[58] Field of Search ..... 40/340, 23 A, 2 R, 23, 40/359, 360

[56] References Cited

U.S. PATENT DOCUMENTS

| | | | |
|---|---|---|---|
| 2,526,950 | 10/1950 | Jones | 40/23 A |
| 2,535,262 | 12/1950 | Brownsey | 40/340 |
| 2,597,426 | 5/1952 | Auckley | 40/23 A |
| 2,771,076 | 11/1956 | Peter | 40/340 X |
| 2,815,595 | 12/1957 | Davis | 40/23 A |
| 3,054,202 | 9/1962 | Schofield | 40/23 A |

*Primary Examiner*—Gene Mancene
*Assistant Examiner*—Wenceslao J. Contreras

[57] ABSTRACT

An index tab securable to a phonograph record album, in order to identify, more easily, the record contained therein; the tab being made of transparent, stiff plastic, and including a part coated with adhesive, for attachment to the album and a part that is folded over, so as to make a pocket for a label, the parts being pivotable respective to each other.

5 Claims, 6 Drawing Figures

10
STEVE WONDER
Steve Wonder
SINGS HIS BEST HITS
21

13
15
12
14
16
18
21
19

10
12
14
13
TITLE AND PERFORMER
11
16
17
15
PULL OFF
19
18
20
JOHNNY CASH
ELTON JOHN
21

24
16
28
31
26
27
19
23
20
25

24
24
22
29
32
30
23

PHONOGRAPH RECORD ALBUM INDEX TABS

This invention relates generally to index tabs.

It is well known, that hunting for a particular long-play, phonograph record album among a stack of other record albums is not easy, if a person tries to read the title on the edge of the album jacket. The albums are usually very thin, so that the title is printed very small, and is, accordingly, very difficult to see. If the records are properly stored standing on a lower edge of the album jacket, then trying to read the title, along the jacket's side edge, necessitates tilting the person's head approximately ninety degrees to the side, which is uncomfortable. This situation is, accordingly, in want of an improvement.

Therefore, it is a principal object of the present invention to provide an index tab designed especially for mounting on a phonograph record album jacket, and which allows a record title to be written or printed thereupon in a large text which can be easily seen, and wherein the tab is positioned on the jacket, so that the title can be read without the necessity of cocking the head at all to a side.

Another object is to provide a record index tab which, in one design, is able to be tilted, so as to eliminate the need to bend down for reading it from a directly forwardly direction, particularly when the records are on a low shelf, or the like.

Other objects are to provide a record index tab, which is simple in design, inexpensive to manufacture, rugged in construction, easy to use and efficient in operation.

These, and other objects, will be readily evident, upon a study of the following specification, and the accompanying drawing, wherein.

Figures 1, 2, 3, 4, 5, 6:
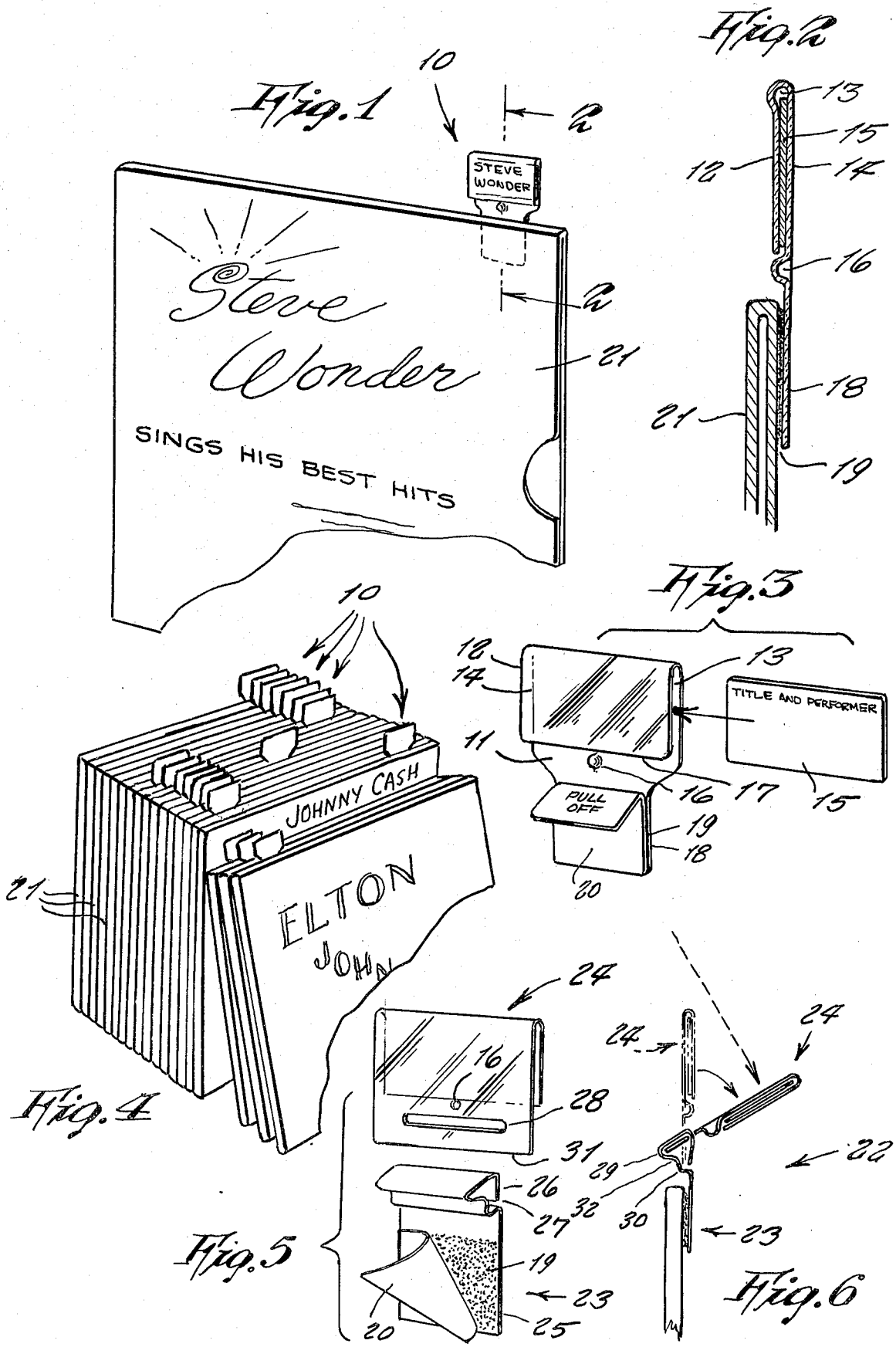
FIG. 1 is a perspective view of the invention, attached to a phonograph record album.
FIG. 2 is an enlarged cross-sectional view, on line 2—2 of FIG. 1.
FIG. 3 is a perspective view of the tab and label, shown alone.
FIG. 4 illustrates a row of albums, with identifying tabs attached thereto.

FIG. 5 shows a modified design of the invention, comprising two parts, so a top one thereof, carrying the label, can be tilted over, so as to be more convenient for being read from above, without the need of stooping over; and FIG. 6 is a side view thereof, and showing the top part in tilted position for a line of sight, and showing it in dotted lines, tilted vertically, for easier storage when albums are stacked close together.

Referring now to the drawing in greater detail, and more particularly, to FIGS. 1 through 4 thereof at this time, the reference numeral 10 represents a record index tab, according to the present invention, wherein there is a stiff sheet 11 of transparent plastic, so as to allow seeing therethrough. One end portion 12 of the sheet is folded over, so as to form a flat pocket 13 therebetween, and an intermediate portion 14, so that a card 15, used as a record label, can be inserted into the pocket. The portions 12 and 14 are relatively wide, so as to enclose the label, which is made sufficiently wide enough, in order that a title of a record work and the name of the performer, or performers, can be written thereupon large enough so as to be easily read.

A single dimple 16, pressed out on the portion 14, is located below a lower edge 17 of the portion 12, and protrudes across the entrance to the pocket, so as to serve as a stop, preventing the label from falling down out of the pocket.

The opposite end 18 of the stiff plastic sheet has pressure sensitive adhesive 19 applied to one side thereof, and the adhesive is then covered by a coated paper 20, for protecting the adhesive prior to use of the index tab, and at which time of use the paper 20 is peeled off, so that the tab can be pressed against a side of an album 21. As shown in FIG. 1, the index tab is positioned so that the label is located where it can be easily viewed for reading, beyond the album edge.

In a modified design of the invention, shown in FIGS. 5 and 6, a record index tab 22 consists of a base 23, stationarily adhered to the album, and a pivotable member 24 supported on the base. The pivotable member can be pivoted between a vertical, storedaway position, as shown by the dotted lines in FIG. 5, and a tilted position for each reading, as shown by the solid lines in the same Figure.

The base includes a lower end 25 coated with pressure sensitive adhesive 19, temporarily covered by removable, protective paper 20. The upper end of the base is rolled over, so as to form a ring 26, and an end edge 27 forms a hook for being inserted into a slot 28 on the pivotable member, which is similar to the upper part of index tab 10, by being made of transparent, stiff plastic, and including a pocket 13 formed between folded-over portions 12 and 14. The ring 26 is generally triangular in shape, with corners 29 and 30 being outwardly bulged, so that an edge 31 of member 24 snaps therein, after riding over a hump 32 therebetween. Thus, the member 24 is retained in either pivoted position. There is enough flexibility in the base material so that the ring opens slightly when the edge 31 over-rides the hump.

While various changes may be made in the detail construction, it is understood that such changes will be within the spirit and scope of the present invention, as is defined by the appended claims.

What I now claim is:

1. A record index tab for a phonograph record album, comprising, in combination, an upper part folded over, so as to form a flat pocket, receiving a card serving as a label, and a lower part coated with adhesive, on one side, for adhering to said album, and said tab being made of transparent, relatively stiff plastic sheeting material; said parts being pivotally connected together by said lower part having a rolledover upper end inserted in a slot near a lower edge of said upper part; a dimple pressed on one side of said upper part intercepting an entrance of said pocket; and stop and snap means, whereby said upper part is pivotably snapped between an upwardly vertical and an angularly upwardly inclined positions.

2. The combination as set forth in claim 1, wherein said stop means comprises said rolled over end, consisting of a roll which, in transverse cross-section, is generally triangular in shape, wherein a flat first side thereof is vertical, and a flat second side thereof is angularly inclined, said upper part pivoting to abut against said vertical and angularly inclined flat first and second sides of said roll.

3. The combination as set forth in claim 2, wherein said snap means comprises a third side of said triangularly-shaped roll, having an outwardly bulge along each transverse end, and an inwardly hump therebetween.

4. The combination as set forth in claim 3, wherein a distance between said lower edge of said upper part and said slot is greater than a distance between said hump of said third side and an opposite corner of said third side.

5. The combination as set forth in claim 4, wherein a distance between said lower edge of said upper part and said slot is less than a distance between said outward bulges of said third side and an opposite corner of said third side.

* * * * *